US005193671A

United States Patent [19]

Patterson

[11] Patent Number: 5,193,671

[45] Date of Patent: Mar. 16, 1993

[54] SHOE STORAGE BOX WITH COMPLEMENTARY SUPPORTING BOX THAT ALSO FUNCTIONS AS A SHOE STORAGE CONTAINER AND A SHOE DISPLAY CONTAINER

[75] Inventor: Claire A. Patterson, National City, Calif.

[73] Assignee: Chauvin International Ltd., Los Angeles, Calif.

[21] Appl. No.: 919,845

[22] Filed: Jul. 27, 1992

[51] Int. Cl.[5] ..... B65D 25/04

[52] U.S. Cl. ..... 206/45.14; 206/278; 206/297; 206/806; 229/120.37

[58] Field of Search ..... 206/44 R, 44.11, 44.12, 206/45.12, 45.14, 45.15, 45.16, 45.19, 278, 279, 292, 297, 806; 229/120.37

[56] References Cited

U.S. PATENT DOCUMENTS 1,781,624 11/1930 Barnes ..... 206/292
1,790,119 1/1931 Stevens ..... 206/278
2,240,810 5/1941 Snelling ..... 206/45.19
2,989,221 6/1961 Butler ..... 229/120.37
4,083,485 4/1978 Bamburg et al. ..... 229/120.37

FOREIGN PATENT DOCUMENTS 0325395 2/1930 United Kingdom ..... 229/120.37

*Primary Examiner*—Jimmy G. Foster
*Attorney, Agent, or Firm*—Thomas I. Rozsa; Dong Chen

[57] ABSTRACT

The present invention is a unique multi-function multi-purposes shoe container. The present invention keeps shoes neatly separated within a large rectangular container by placing a second container within the larger container. The second container has a right compartment and a left compartment for retaining the respective one of a pair of shoes. The second container can be removed from the larger container so that the pair shoes can be retained and displayed within the second container in vertical positions.

18 Claims, 2 Drawing Sheets

FIG. 1
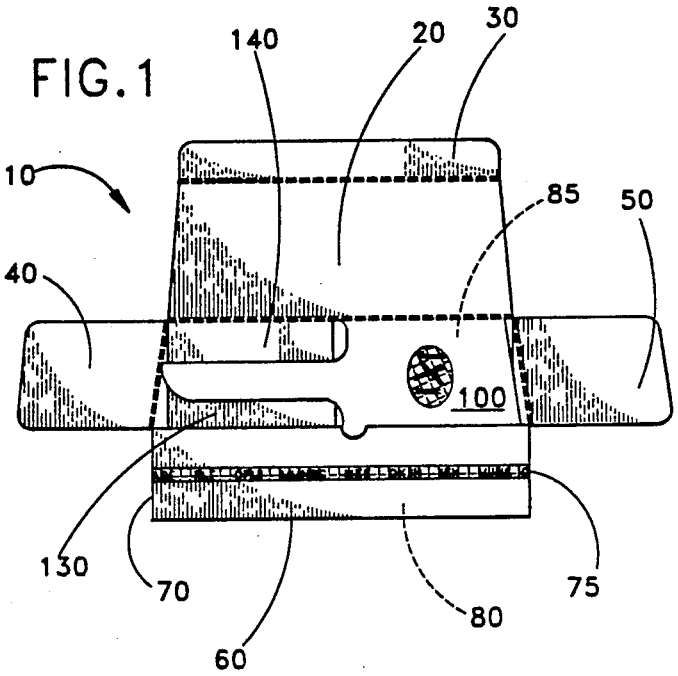
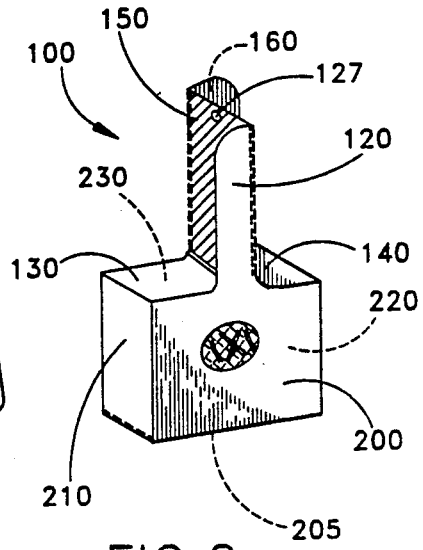
FIG. 2
FIG. 8
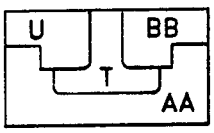
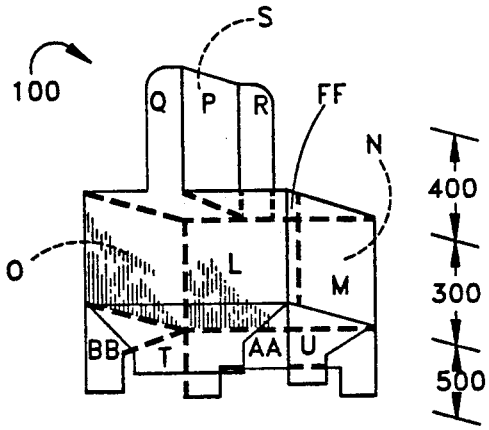
FIG. 3
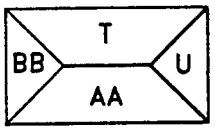
FIG. 9

FIG.5
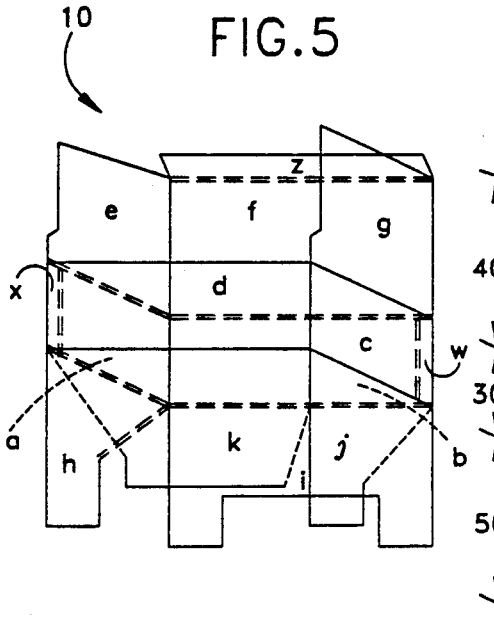
FIG.4
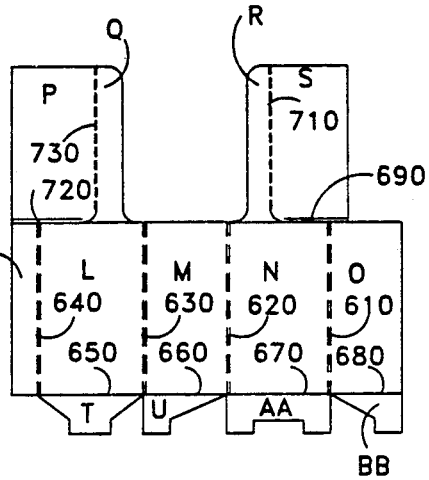
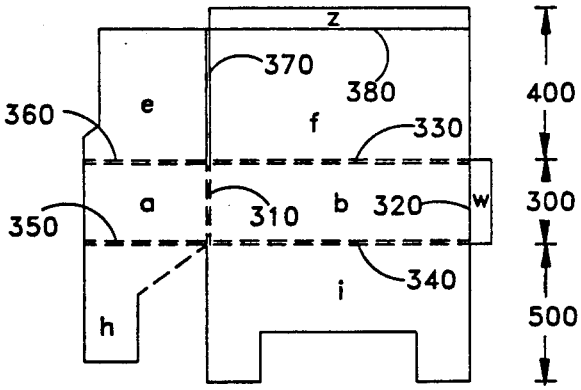
FIG.6
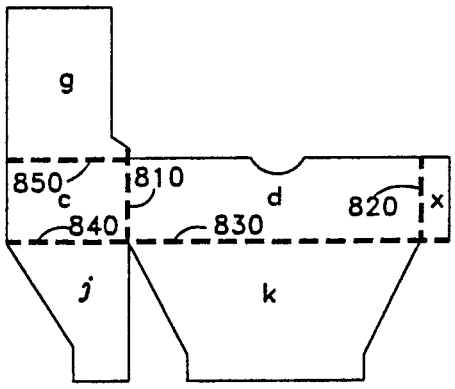
FIG.7

SHOE STORAGE BOX WITH COMPLEMENTARY SUPPORTING BOX THAT ALSO FUNCTIONS AS A SHOE STORAGE CONTAINER AND A SHOE DISPLAY CONTAINER

BACKGROUND OF THE INVENTION

1. Field of the Invention

This invention relates to the field of shoe boxes. Specifically, the present invention is related to the field of shoe boxes which keep shoes neatly separated within the box by placing a second box within the larger box. The second box stores each shoe individually with the soles facing inward. The second box is a supporting box and can be removed from the larger box so that the shoes can be hung up, or the container can be placed in an upright position to store the shoes in a neat, compact manner.

2. Description of the Prior Art

Part of the problem which the present invention addresses, is that when shoes are stored or transported in a shoe box, they should be separated. This is usually accomplished by individually wrapping each shoe with tissue, then placing the shoes into the box. The shoes wrapped in tissue rub against one another in this arrangement. The left and the right shoe are usually separated in this manner. Shoes which are sold at shoe stores are often tried on for size, then worn around the showroom and then returned to their box.

Once the shoes are brought home it would be useful to have a convenient storage container for the shoes which could retain them when the shoes are not being worn. It would be a further benefit if the shoe box was attractive to the consumer and could be used to promote sales in a retail display.

There is a significant need for such an improved shoe box.

SUMMARY OF THE PRESENT INVENTION

The present invention is a unique shoe and supporting box for retaining and storing shoes so they are supported in their positions within the box. The two boxes of the present invention are designed to be efficient for use as an improved transporting and storage box for shoes. In addition, the boxes are designed to be attractive and appealing to the consumer. The two boxes can also be used for a retail display.

The present invention provides a solution to the problems of shoe storage, through an innovative two box container for shoe storage which is pleasing to the consumer and can be used in a retail display.

There is a first box which is a rectangular box that has a lid which closes and tucks into the box. The rectangular box is made from a cardboard type fold pattern. The rectangular box is generally appealing, with its sturdy design and colorfully painted exterior surface.

The second box, a supporting box, fits into the rectangular box. The supporting box has a compartment for a right shoe and a compartment for the left shoe which compartments are partially separated by a plate which the soles of each of the shoes face. There is also a side flap for the right shoe and left shoe which helps to keep the shoes positioned upright when they are placed in the supporting box. The supporting box keeps the shoes separated while they are stored in the rectangular box. The supporting box can also be removed from the rectangular box so that shoes could be hung up by a hole placed in the plate of the supporting box or the supporting box can be placed upright to store the shoes in a manner that doesn't take up excessive space.

The rectangular box and supporting box combination, while presenting several benefits to the consumer, also provide a significant benefit to the manufacturer in terms of marketing. For purposes of displaying the shoes in a shoe store ambience, the shoes can be arranged on the rectangular box where the shoes are extending out of the supporting box. The supporting box can also be hung up on a rack. The supporting box can provide a stand alone platform for the shoes to be displayed. Both the supporting box and the rectangular box could be painted with a colorful trademark which reminds the potential customer of the quality of the merchandise. Attractive packaging, such as that in the present invention, can contribute to a higher sales volume.

The primary uniqueness of the present invention is the design and construction of the supporting shoe box. More particularly, the uniqueness of the present invention includes: (a) the rectangular box design, which has a lid and a fold flap which closes and tucks into the box; (b) the design of the supporting box which conformably fits into the rectangular box; (c) the compartments for a right shoe and a left shoe with a separator plate at the upper region of the supporting box; (d) the fold and cut pattern of rectangular box and the supporting box; (e) the sturdy multi-layer paper and corrugated cardboard construction; (f) the side flap for the right shoe and the side flap for the left shoe which helps to keep the shoes positioned upright when they are placed in the supporting box; (g) the option of using the supporting box for hanging up the shoes or storing the shoes on the floor upright; and (h) the attractively painted design of the exterior surfaces.

In addition, the rectangular box and supporting box combination provides a significant benefit to the manufacturer in terms of marketing. Aside from having attractively painted exterior surfaces of the boxes which can include the trademark, the shoes can be situated in various arrangements utilizing the supporting box alone, or the supporting box in combination with the rectangular box for a retail display. The consumer would find it desirable to use the two boxes to retain shoes in their closet or elsewhere at home. The present invention is both functional and attractive to the consumer.

It has been discovered, according to the present invention, that shoes could be sold, stored and transported in a two box configuration, where a supporting box is retained inside a rectangular box.

It has also been discovered, according to the present invention, that the supporting box could include: a compartment for a right shoe and a compartment for a left shoe; a separator plate for partially separating the shoes in their respective compartments and keeping the structural rigidity of the supporting box intact; a side flap for the right shoe and the side flap for the left shoe which helps to keep the shoes positioned upright when they are placed in the supporting box; and the option of using the supporting box for hanging up the shoes or storing the shoes in an upright position.

It has been further discovered, according to the present invention, that a fold and cut pattern of rectangular box and supporting box could allow the manufacturing of each box to be constructed from a sturdy multi-layer paper and cardboard construction through a series of cuts and folds.

It has been additionally discovered, according to the present invention, that a colorful painted design of the exterior surfaces, for the rectangular box and the supporting box, could provide a pleasantly appealing package for marketing and displaying shoes. The shoes could be situated in various arrangements utilizing the supporting box or the supporting box in combination with the rectangular box for a retail display.

It is therefore an object of the present invention to provide a two box container for shoes, where a supporting box is retained inside a rectangular box.

It is also an object of the present invention to provide a supporting box which includes: a compartment for a right shoe and a compartment for the left shoe; a separator plate for partially separating the shoes and keeping the structural rigidity of the supporting box intact; a side flap for the right shoe and a side flap for the left shoe which helps to keep the shoes positioned upright when they are placed in the supporting box; and the option of using the supporting box for hanging up or storing the shoes in an upright position.

It is also an object of the present invention to provide a fold and cut pattern of the rectangular box and supporting box which could allow each box to be manufactured from a sturdy multi-layer paper and cardboard construction through a series of cuts and folds.

It is an additional object of the present invention, to provide a colorful painted design on the exterior surfaces, for the rectangular box and the supporting box, to provide a pleasantly appealing package for marketing and displaying shoes, so that the shoes could be situated in various arrangements utilizing the supporting box or the supporting box in combination with the rectangular box for a retail display.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the rectangular box and the supporting box contained therein.

FIG. 2 is a perspective view of the supporting box.

FIG. 3 is a perspective view of the supporting box with the base sections folded out.

FIG. 4 is a top plan view of the unfolded pattern of the supporting box.

FIG. 5 is a perspective view of the rectangular box with the sections folded out.

FIG. 6 is a top plan view of one half of the unfolded rectangular box pattern, including the lid.

FIG. 7 is a top plan view of the other half (not including the lid as in FIG. 6) of the unfolded rectangular box pattern.

FIG. 8 is a top plan view of the base folded pattern as seen looking into the rectangular or supporting box.

FIG. 9 is a bottom plan view of the base folded pattern as seen from the exterior of the rectangular or supporting box.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIG. 1, there is a depiction of the box within a box arrangement. There is a rectangular box 10 which is shown with the supporting box 100 inside of the rectangular box 10. While the supporting box 100 is retained inside the rectangular box 10, the supporting box 100 has four flat surfaces. Each flat surface of the supporting box 100 are in planes parallel to the planes of the rectangular box 10. The supporting box 100 fits comformably to the rectangular box 10.

The shoes are retained in the left shoe compartment 130 and the right shoe compartment 140 of the supporting box 100. There is no difference between the left shoe compartment 130 and the right shoe compartment 140. The left and right shoe compartments are symmetrical and are designated as such for reference only.

Referring to FIG. 2, the supporting box 100 is shown. The right shoe compartment 140 and the left shoe compartment 130 are separated by an extension of the plane of the shoe separator plate 150. The shoes could be placed into the supporting box 100 with the soles of the shoes, or the heels of the shoes, facing the shoe separator plate 150. The shoe separator plate 150 is constructed from a double thickness of material. The supporting box 100 can hold shoes in the upright position while seated on its supporting box base 205. The supporting box 100 could be placed into a closet, either hung up at the hangar hole 127 or stored on the closet floor which provides an easily accessible location for storing shoes. If the shoes are placed on the closet floor, closet floor space is economized because the shoes are arranged vertically, In general, the supporting box 100 provides a container to neatly store the shoes.

Referring again to FIG. 1, the rectangular box 10 is shown having a closing lid 20 with a forward lid flap 30 to tuck into the rectangular box 10 to close it securely. There is also a left side flap 40 and a right side flap 50 which close, into the box, from the sides thereby sealing the sides when the closing lid 20 clamps down onto the side flaps from above the rectangular box 10.

At the lower part of the rectangular box 10, is the front body 60 which is generally printed with an attractive trademark logo. This provides opportunity for the manufacturer to advertise his trademark and also allows the consumer to identify with the quality of the product.

Referring again to FIG. 1, facing the front body 60 of the rectangular box 10; at the left surface, adjacent to the front body 60 there is a left side body 70 and opposite to the left side body 70 there is a right side body 75. At the back surface of the rectangular box 10 there is a back side body 85 which hingably connects to the closing lid 20. The entire rectangular box 10 rests on the rectangular box base 80.

The exterior surface of both the rectangular box 10 and the supporting box 100 are designed to be aesthetically appealing, so it is designed and painted with an interesting color scheme. It can also have pattern indentations which provide an additional artistic detail to the surface. The boxes may be also be laminated with a smooth glossy surface. The boxes could be constructed of cardboard, multi-layer paper, corrugated paper or a combination thereof. In general, the boxes could be made from any pliable material. Paper material could be obtained from any source, including a recycled paper source. The material should be stiff enough to maintain its form over repeated usage.

In general, the boxes provide an attractive, sturdy, shoe container which the consumer can utilize long after the shoes have been purchased, to retain their shoes, or retain other items as they desire.

Another version of the rectangular box could be introduced which involves one or more thin transparent plastic windows, where thin transparent material or semi-transparent colored plastic material is placed at a cut out aperture of the lid, which would allow the consumer to view the styles of shoes from the outside of the box without needing to open the lid of the box. This kind of box arrangement would also be attractive to the consumer and assist in the display and marketability of the product.

Referring again to FIG. 2, the supporting box 100 is shown in an upright position, seated on the supporting box base 205. The supporting box 100 has four lower sides: there is the supporting box front side 200; to the left is the supporting box left side 210; oppositely disposed to the supporting box left side 210 is the supporting box right side 220; and opposite to the supporting box front side 200 is the supporting box back side 230. Corresponding to the left shoe compartment 130 is a left shoe flap 120 and corresponding to the right shoe compartment 140 is a right shoe flap 160, both of which help to retain the shoes in the supporting box 100.

In the present embodiment, the left shoe compartment 130 and the right shoe compartment 140 are separated by the shoe separator plate 150 only at the upper half of the supporting box 100. The shoe separator plate 150 generally extends from the apex of the supporting box 100 to the mid section of the box, to the extent of the left shoe flap 120 and the right shoe flap 160, until the flaps meet the rectangular supporting box front side 200 and the supporting box back side 230. The shoe separator plate 150 helps to maintain the structural rigidity of the supporting box 100.

Referring to FIG. 3, the supporting box 100 is shown in a perspective view. For easy referencing, the figure is divided into three regions. There is a middle region 300, an upper region 400 and a lower region 500. Each region has a plurality of pattern sections, which are referenced by letter. The lettered pattern sections correspond to the lettered sections of the unfolded pattern of the supporting box 100 shown in FIG. 4.

Referring to FIG. 3, starting at the middle region 300, there are four pattern sections: section L, section O, section N, and section M. The four sections form the four sides of a box. There is a join flap FF which is folded from section L which is glued to the inside of section M. Generally, the join flap FF is glued, but it can also be stapled, taped or fastened in an interlocking fit. The join flap connects and joins the sections of the middle region 300.

In the upper region 400, there are three flat planarities, which result from the folding of four sections: there are two parallel plane sections, section Q, and section R; and there is a third intersecting planarity which connects section Q and section R resulting from the double thickness of the double layer of section P and section S. The double thickness of the third planarity of section P and section S can be held together by staples, glue or an interlocking fit. In the present embodiment, the double thickness is held by staples disposed near the upper corners of the two sections, section P and section S. The two staples are placed at the upper lateral corners of section P and section S, in an orientation parallel to the upper edge of the two sections.

In the lower region 500, there are four sections: the two side flaps, section BB and section U; and the two interlocking flaps from the staple-like section AA and the tapered section T. All four sections of the lower region 500 are designed in a base pattern to be folded up.

Referring to FIG. 8 and FIG. 9, the fold of the base pattern for both the rectangular box 10 and the supporting box 100 is shown.

Referring to FIG. 8, the fold-up of the base pattern is shown from the point of view of looking inside either the supporting box 100 or the rectangular box 10. There is an interlocking fit to the sections of the base. The sections fit neatly where the tapered section T fits in an interlock with staple-like section AA.

To perform the interlocking fold fit, the staple-like section AA is folded inward first. The staple-like section AA is folded inward to establish an orientation which is planar to the base of the box. Next, the side flaps, segment U and segment BB are folded inward. The interlock is achieved by the tapered section T closing into a slot formed by the first three sections, fit so the narrow part is slightly bent so that it can protrude through to the inner part of the box, easily sliding into the opening.

Referring to FIG. 9, when the base pattern is folded and interlocked properly, the bottom exterior of the rectangular box 10 or the supporting box 100 will have an envelope pattern. The tapered section T is pushed into the slot formed by the staple-like section AA, which is further braced by the side sections, section BB and section U.

Referring to FIG. 4, the pattern for the supporting box 100 of FIG. 3 is shown. There are several cuts and folds of the pattern depicted in this illustration. The plurality of cuts and folds in the following patterns are assigned designations as follows. The designation such as "fold (L,M) 630", means, there is a fold between section L and section M is referenced at number "630" on the diagram. Similarly, the designation, "cut (Q,P) 730", is intended to mean, there is a cut between section Q and section P at number "730" on the diagram.

At the middle region 300, there are several folds between the sections of the middle region 300: there is fold (FF,L) 640, fold (L,M) 630, fold (N,M) 620 and fold (O,N) 610.

There are several folds between the sections of the middle region 300 and the sections of the lower region 500: there is fold (O,BB) 680, fold (N,AA) 670, fold (M,U) 660 and fold (L,T) 650.

There are two cuts between the middle region 300 and the upper region 400. There is cut (P,FF-L) 720, which is generally linear between sections P and the two sections FF L, which curves upward between sections P and Q. There is also a cut (S,N-O) 690, which is generally linear between section S and the two sections O and N, which also curves upward between sections S and R. These two cuts diverge to form a smooth curve to an upward orientation to allow the flat separator plate sections to be joined by bending the sections inward. The upward segment of the cut is only severed at the lower part between sections Q and P, and between sections S and R.

In the upper region 400 there are folds at fold (P,Q) 730 and fold (R,S) 710.

Referring to FIG. 5, FIG. 6 and FIG. 7, the structural aspects of the rectangular box 10 construction from its cut and fold pattern are depicted. The pattern arrangement of the rectangular box can be observed as having three basic regions. There is a middle region 1300 attached to flap members of an upper region 1400 and the middle region 1300 is also attached to the flap members of the lower region 1500. The flap members of the upper region 1400 and the lower region 1500 are hingably joined to the middle region 1300 by creasing and folding the cardboard, multilayered paper, corrugated paper, or generally pliable material structure.

Referring to FIG. 5, in the middle region 300, there are four middle sections: section d, section a, section b, and section c. There are also two join flaps, join flap x and join flap w, which overlap at respective symmetrical locations by two diametric corners of the middle region 300. These join flaps, join flap x and join flap w, are generally glued into place but could also be stapled or fastened in an interlocking fit.

An interlocking fit to the join flaps could include a slot at the inside of the box. One or more join flaps could be bent inwardly and inserted into the slot. The stiffness of the box material could retain the join flap to the inside of the box and prevent the box from unfolding. There could also be a combination glue and interlocking fit to the join flaps. Since the join flaps hold the sections of the middle region 300 together, the attachment of the join flaps should be secure.

In the upper region 1400, there are four upper sections: there are two side flaps, section e, and section g; and the two parts of the lid, section f, and section z.

In the lower region 1500, there are four lower sections which form the interlocking fit as previously discussed in FIG. 8 and FIG. 9. The lower region 1500 sections are: the two side flaps, section h and section j; and the staple-like section i and tapered section k which is formed by the base pattern into an interlocking fit.

The rectangular box 10 is formed from two flat patterns. Referring to FIGS. 6 and 7, the flat patterns of the rectangular box 10 are shown unfolded. There are cuts and folds of the pattern depicted in this illustration. To facilitate designation of the cuts and folds in the pattern, the designation for each fold and a cut is as follows. The designation such as "fold (a,e) 360" means there is a fold between section a and section e referenced at number "360" on the diagram. The designation for a cut is referenced by a designation such as "cut (e,f) 370" meaning there is a cut between sections e and f at number "370" on the diagram.

Referring to FIG. 6 and FIG. 7, at the middle region 1300, there are several folds between the sections of the middle region 1400: there is a fold (a,b) 310, a fold (b,w) 320, fold (c,d) 810, and a fold (d,x) 820.

There are also several folds between the section of the middle region 1300 and the lower region 1500. There is a fold (a,h) 350, a fold (b,i) 340 a fold (c,j) 840 and a fold (d,k) 830.

There are several folds between the sections of the middle region 300 and the upper region 400: there is fold (a,e) 360, fold (b,f) 330 and fold (c,g) 850.

In the upper region 1400, exclusively, there is a cut, cut (e,f) 370 and a fold, fold (f,z) 380.

It is appreciated that the scope of the present invention is not limited to the above described embodiments. The materials, configurations, dimensions, patterns and methods of folding of the large outer shoe storage container and the inner shoe supporting container may have many suitable variations.

Defined in detail, the present invention is a multiple function shoe box for transportation, storage and display purposes, comprising: (a) an outer shoe storage box and a complementary inner shoe supporting box which can be conformably fitted inside the outer storage box; (b) said outer box being made of foldable and patterned cardboard material and having a rectangular shaped configuration with a top plate, a bottom plate, a front plate, a back plate and two opposite end plates, which plates define a rectangular shaped interior compartment, the top plate being openable for accessing the interior compartment; (c) said inner box being constructed from an integral piece of foldable and patterned cardboard material and having a lying-down position for holding a pair of shoes within said interior compartment of said outer box, and an upright position for supporting the pair of shoes vertically; (d) said inner box having an exposed upper portion and a rectangular shaped lower portion, the lower portion having an uncovered top which opens into the upper portion, the lower portion further having a base plate, a front plate, a back plate and two opposite end plates; (e) said inner box being conformable with said outer box, such that when said inner box is lying-down within said interior compartment of said outer box, said base plate of said lower portion of said inner box conforms with one of said two opposite end plates of said outer box, said front plate of said lower portion of said inner box conforms with said top plate of said outer box, said back plate of said lower portion of said inner box conforms with said bottom of said outer box, and said two end plates of said lower portion of said inner box conform respectively with said front and back plates of said outer box; and (f) said exposed upper portion of said inner box having a narrowly extended right plate and a narrowly extended left plate, the right and left narrow plates being offset and interconnected by a partition plate which provides said inner box with a right shoe compartment and a left shoe compartment; (g) whereby said pair of shoes can be placed respectively in said right shoe compartment and said left shoe compartment of said inner box, when said inner box is lying-down inside said outer box, it will help to keep said pair of shoes in stabilized positions for storage and transportation purposes, when said inner box is set upright, it will support said pair of shoes in vertical positions, where said exposed upper portion of said inner box makes said pair shoes visible for retaining and display purposes.

Defined broadly, the present invention is a multiple purpose shoe container, comprising: (a) an outer shoe storage box and a complementary inner shoe supporting box which can be conformably fitted inside the outer storage box; (b) said outer box having a generally rectangular shaped configuration with a top plate, a bottom plate and four sidewall plates, which plates define a generally rectangular shaped interior compartment, the top plate being openable for accessing the interior compartment; and (c) said inner box having an exposed upper portion and a generally rectangular shaped lower portion, the lower portion having a base plate and four sidewall plates, and the exposed upper portion having a narrowly extended right supporting plate and a narrowly extended left supporting plate, the right and left narrow supporting plates being offset and interconnected by a partition plate which provides said inner box with a right shoe compartment and a left shoe compartment; (d) whereby said pair of shoes can be placed respectively in said right shoe compartment and said left shoe compartment of said inner box, when said inner box is placed inside said outer box, it will help to keep said pair of shoes in stabilized positions for storage and transportation purposes, when said inner box is set upright, it will support said pair of shoes in vertical positions, where said exposed upper portion of said inner box makes said pair shoes visible for retaining and display purposes.

Defined more broadly, the present invention is a multi-function shoe container, comprising: (a) an outer shoe storage container and a complementary inner shoe supporting container which can be conformably fitted inside the outer storage container; (b) said inner container having an exposed upper portion and a lower portion, the lower portion having a bottom and circumscribing sidewalls; and (c) said inner container further divided into a right shoe compartment and a left shoe compartment by a partition plate, each shoe compartment having at least one stiff narrow plate upwardly stemming from said circumscribing sidewalls of said lower portion into said exposed upper portion for supporting a respective one of a pair of shoes in a vertical position; (d) whereby said pair of shoes can be placed respectively in said right shoe compartment and said left shoe compartment of said inner container, when said inner container is placed inside said outer container, it will help to keep said pair of shoes in stabilized positions for storage and transportation purposes, when said inner container is set upright, it will support said pair of shoes in vertical positions, where said exposed upper portion of said inner container makes said pair shoes visible for retaining and display purposes.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A multiple function shoe box for transportation, storage and display purposes, comprising:

a. an outer shoe storage box and a complementary inner shoe supporting box which can be conformably fitted inside the outer storage box;

b. said outer box being made of foldable and patterned cardboard material and having a rectangular shaped configuration with a top plate, a bottom plate, a front plate, a back plate and two opposite end plates, which plates define a rectangular shaped interior compartment, the top plate being openable for accessing the interior compartment;

c. said inner box being constructed from an integral piece of foldable and patterned cardboard material and having a lying-down position for holding a pair of shoes within said interior compartment of said outer box, and an upright position for supporting the pair of shoes vertically;

d. said inner box having an exposed upper portion and a rectangular shaped lower portion, the lower portion having an uncovered top which opens into the upper portion, the lower portion further having a base plate, a front plate, a back plate and two opposite end plates;

e. said inner box being conformable with said outer box, such that when said inner box is lying-down within said interior compartment of said outer box, said base plate of said lower portion of said inner box conforms with one of said two opposite end plates of said outer box, said front plate of said lower portion of said inner box conforms with said top plate of said outer box, said back plate of said lower portion of said inner box conforms with said bottom of said outer box, and said two end plates of said lower portion of said inner box conform respectively with said front and back plates of said outer box; and f. said exposed upper portion of said inner box having a narrowly extended right plate and a narrowly extended left plate, the right and left narrow plates being offset and interconnected by a partition plate which provides said inner box with a right shoe compartment and a left shoe compartment;

g. whereby said pair of shoes can be placed respectively in said right shoe compartment and said left shoe compartment of said inner box, when said inner box is lying-down inside said outer box, it will help to keep said pair of shoes in stabilized positions for storage and transportation purposes, when said inner box is set upright, it will support said pair of shoes in vertical positions, where said exposed upper portion of said inner box makes said pair shoes visible for retaining and display purposes.

2. The invention as defined in claim 1 wherein said outer storage box and said inner supporting box both have laminated exterior surfaces.

3. The invention as defined in claim 1 wherein said outer storage box has at least one window made of thin transparent plastic material.

4. The invention as defined in claim 1 wherein said top plate of said outer storage box is connected with said back plate but disconnected with said front plate and said two opposite end plates, such that said top plate can be hingably opened and closed.

5. The invention as defined in claim 4 wherein said top plate of said outer storage box further comprises a foldable front tucking flap for locking said front plate in its closed position.

6. The invention as defined in claim 4 wherein said outer storage box further comprises two opposite top flaps which can be folded inwardly under said top plate for providing additional protection.

7. The invention as defined in claim 1 wherein said bottom plate of said outer storage box is formed by four interlocking sections including a tapered section, a notched section and two end flap sections.

8. The invention as defined in claim 1 wherein said base plate of said lower portion of said inner supporting box is formed by four interlocking sections including a tapered section, a notched section and two end flap sections.

9. The invention in accordance with claim 1 wherein said partition plate of said upper portion of said inner supporting box is formed by two stacked flaps which respectively connect to said right and left narrow plates thereof for increasing the strength of said partition plate.

10. The invention in accordance with claim 1 wherein said partition plate of said upper portion of said inner supporting box has a small opening to accommodate means for hanging said inner supporting box such that said pair of shoes can be stored and displayed in suspended positions.

11. A multiple purpose shoe container, comprising:

a. an outer shoe storage box and a complementary inner shoe supporting box which can be conformably fitted inside the outer storage box, where the inner supporting box is made of a unitary piece of foldable and patterned cardboard material;

b. said outer box having a generally rectangular shaped configuration with a top plate, a bottom plate and four sidewall plates, which plates define a generally rectangular shaped interior compartment, the top plate being openable for accessing the interior compartment; and c. said inner box having an exposed upper portion and a generally rectangular shaped lower portion, the lower portion having a base plate and four sidewall plates, and the exposed upper portion having a narrowly extended right supporting plate and a narrowly extended left supporting plate, the right and left narrow supporting plates being offset and interconnected by a partition plate which provides said inner box with a right shoe compartment and a left shoe compartment;

d. whereby said pair of shoes can be placed respectively in said right shoe compartment and said left shoe compartment of said inner box, when said inner box is placed inside said outer box, it will help to keep said pair of shoes in stabilized positions for storage and transportation purposes, when said inner box is set upright, it will support said pair of shoes in vertical positions, where said exposed upper portion of said inner box makes said pair shoes visible for retaining and display purposes.

12. The invention as defined in claim 11 wherein said outer storage box is made of two pieces of foldable and patterned cardboard material.

13. The invention as defined in claim 11 wherein said outer storage box and said inner supporting box both have laminated exterior surfaces.

14. The invention as defined in claim 11 wherein said outer storage box has at least one window made of thin transparent plastic material.

15. The invention in accordance with claim 11 wherein said partition plate of said upper portion of said inner supporting box has a small opening to accommodate means for hanging said inner supporting box such that said pair of shoes can be retained and displayed in suspended positions.

16. A multi-function shoe container, comprising:

a. an outer shoe storage container and a complementary inner shoe supporting container which can be conformably fitted inside the outer storage container, where the inner supporting container is made of a unitary piece of foldable and patterned cardboard material;

b. said inner container having an exposed upper portion and a lower portion, the lower portion having a bottom and circumscribing sidewalls; and c. said inner container further divided into a right shoe compartment and a left shoe compartment by a partition plate, each shoe compartment having at least one stiff narrow plate upwardly stemming from said circumscribing sidewalls of said lower portion into said exposed upper portion for supporting a respective one of a pair of shoes in a vertical position;

d. whereby said pair of shoes can be placed respectively in said right shoe compartment and said left shoe compartment of said inner container, when said inner container is placed inside said outer container, it will help to keep said pair of shoes in stabilized positions for storage and transportation purposes, when said inner container is set upright, it will support said pair of shoes in vertical positions, where said exposed upper portion of said inner container makes said pair shoes visible for retaining and display purposes.

17. The invention as defined in claim 16 wherein said at least one stiff narrow plate of said right shoe compartment of said inner container and said at least one stiff narrow plate of said left shoe compartment of said inner container are interconnected by said partition plate.

18. The invention in accordance with claim 16 wherein said partition plate of said upper portion of said inner supporting container has a small opening to accommodate means for hanging said inner supporting container such that said pair of shoes can be retained and displayed in suspended positions.

* * * * *